US005676410A

United States Patent [19]

Angerbrandt

[11] Patent Number: 5,676,410

[45] Date of Patent: Oct. 14, 1997

[54] HOME SECURITY DEVICE

[76] Inventor: William Angerbrandt, 929 West Galbraith, Melvin, Mich. 48454

[21] Appl. No.: 609,793

[22] Filed: Mar. 1, 1996

[51] Int. Cl.[6] ..... E05C 17/44

[52] U.S. Cl. ..... 292/338; 292/288; 292/DIG. 15

[58] Field of Search ..... 292/338, 339, 292/288, 292, DIG. 15, 343

[56] References Cited

U.S. PATENT DOCUMENTS

| | | | |
|---|---|---|---|
| 855,961 | 6/1907 | Merring . | |
| 1,481,501 | 1/1924 | Britten et al. . | |
| 2,414,404 | 1/1947 | Youther . | |
| 2,673,760 | 3/1954 | Hawks | 292/338 |
| 4,070,050 | 1/1978 | Glock et al. | 292/339 |
| 4,136,899 | 1/1979 | Frasher | 292/DIG. 15 X |
| 4,563,027 | 1/1986 | Chechovsky et al. | 292/339 |
| 4,607,870 | 8/1986 | Crisp, Jr. et al. | 292/DIG. 15 X |
| 4,715,629 | 12/1987 | Robinson . | |
| 4,789,123 | 12/1988 | Mattson | 292/338 X |
| 4,822,086 | 4/1989 | Brown | 292/DIG. 15 X |
| 4,979,769 | 12/1990 | Salyer | 292/338 |
| 5,039,147 | 8/1991 | Moon et al. | 292/338 |
| 5,282,658 | 2/1994 | Reeves | 292/DIG. 15 X |
| 5,340,175 | 8/1994 | Wood | 292/339 |
| 5,540,467 | 7/1996 | Briffa | 292/288 |

FOREIGN PATENT DOCUMENTS

| | | |
|---|---|---|
| 948338 | 7/1949 | France . |
| 980928 | 5/1951 | France . |
| 1399644 | 4/1965 | France . |
| 2364467 | 6/1975 | Germany . |
| 519034 | 3/1940 | United Kingdom . |
| 2177749 | 1/1987 | United Kingdom . |

OTHER PUBLICATIONS

Popular Science, Nov. 1941.

*Primary Examiner*—Rodney M. Lindsey
*Assistant Examiner*—Monica E. Millner
*Attorney, Agent, or Firm*—Cargill & Associates; Susan M. Cornwall

[57] ABSTRACT

A home security device comprising a first attachment device, mounted on a distal end of a first rigid arm, adapted to be removably secured to a door or window, a second attachment device, mounted on a distal end of a second rigid arm, adapted to be removably secured to a floor or wall adjacent to the door or window, proximal ends of the first and second rigid arms positioned end to end forming a substantially straight line, and a fastening device, releasably holding the proximal ends in position, adapted to remain secure against force exerted at the distal ends of the rigid arms and to release the proximal ends from position in response to force exerted near the proximal ends and substantially perpendicular to the axis of the rigid arms.

20 Claims, 5 Drawing Sheets

HOME SECURITY DEVICE

BACKGROUND OF THE INVENTION

This invention relates to a security device to prevent a door or a window from being forced open from the outside while being easy to kick aside in case people inside need to get out of the house quickly in the case of an emergency, such as a fire.

Crimes such as breaking and entering, burglary and home invasion are problems that often lead to injury to occupants of the home being invaded. To prevent such illegal entries through doors or windows, a number of security devices have been developed which attempt to secure the door by bolts, braces or the like. Although many of these devices effectively prevent entry, they tend to be difficult to engage and, once engaged, they are difficult to release quickly from the inside. Specifically, some known devices require a key or tool for release, while others require skillful manipulation such as combination locks or require both hands to release them. Specifically, I came up with this invention when I saw a newscast about children that had died in a fire, next to the door, because they couldn't unlock the security device to get outside. Had the security device been easier to unlock, they might have lived.

SUMMARY OF THE INVENTION

It is, therefore, an object of my invention to provide a home security device which provides a door or window security device which not only prevents intruders from forcing the door or window open, but will also allow the occupants of the home to quickly release the device without tools, keys or the like to get outside in case of an emergency.

The present invention provides a door or window security device including a first attachment device, mounted on a distal end of a first rigid arm, adapted to be removably secured to a door, a second attachment device, mounted on a distal end of a second rigid arm, adapted to be removably secured to a floor or wall adjacent the door or window, two proximal ends of the first and second rigid arms positioned end to end forming a substantially straight line, and a fastening device, releasably holding the proximal ends in position, adapted to remain secure against force exerted at the distal ends of the rigid arms and to release the proximal ends from position in response to force exerted near the proximal ends and substantially perpendicular to the axis of the rigid arms.

It is preferable for the two rigid arms to have the same shape and size , and to be hollow in cross-section.

Most preferably, the present invention provides a door security device where the fastening device is a spring, partially internal to the proximal ends, holding the proximal ends in abutment. One of the proximal ends with a rigid internal lining have an external terminal end extending past the proximal end of the rigid arm which surrounds the internal lining. This terminal end has a bevel extending circumferentially around the outer perimeter of the external terminal end, which allows interlocking of the hollow arms while facilitating pivotal motion at the bevel. The second proximal end with a rigid internal lining terminates before reaching the second proximal end of the rigid arm which surrounds the internal lining.

My door security device includes first and second arms of equal diameter, the first arm having one beveled end and one securable end, the second arm having one abutting end and one securable end, and the securable ends are adapted to be releasably secured one to a door, and one to a floor adjacent the door, and a fastening device connected to the abutting end and the beveled end, holding the beveled end against the abutting end, thereby releasably locking the two arms together such that force transmitted substantially along the longitudinal axis of the device will not cause the abutting and beveled ends to disengage, while force exerted in the house, on the fastening device, and substantially perpendicular to that axis, will cause disengagement.

Furthermore, the door security device may have two rigid arms which are solid in cross-section. The fastening device may be pivot a hinge, or any other pivoting means besides a spring.

One of the preferred embodiments of the present invention provides a door security device including a first rigid tube having a proximal end, a second rigid tube of equal diameter, also having a proximal end, the tubes being positioned proximal end to proximal end, the first rigid tube also having a distal end adapted to be removably secured to a door, the second tube also having a distal end adapted to be removably secured to a floor adjacent the door, and a spring positioned between and connecting the proximal ends of the two rigid tubes, releasably holding them in position, such that when the device is secured to the door and the floor, the device prevents opening of the door from outside, but allows occupants to release the device by exerting force against a side of the tubes near the proximal ends.

The distal end of the first rigid tube may be adapted to be removably secured to a door having a Y-shaped fitting to be positioned under a doorknob. Another embodiment provides at least one distal end adapted to be removably secured by frictional engagement between the distal end and a surface. Means for engagement to the door and the floor may include any suitable device known to one of ordinary skill in the art.

The distal end of the second rigid tube may include an attachment device having a manipulable female engaging fixture for engaging a male engaging fixture attached to the door or floor adjacent the door. An alternative is to provide at least one distal end with an attachment device including a manipulable male engaging fixture for engaging a female engaging fixture attached to the door or floor adjacent the door. Otherwise, one can provide a manipulable male engaging fixture in the form of a terminal surface closing the distal end of the tube, and at least one shaft, firmly fixed to the tube, extending outward past the surface for engaging a corresponding female fixture.

Furthermore, the door security device may have a flexible protective casing covering a length of the rigid arms which includes the fastening device and the proximal ends of the two rigid arms, extending circumferentially around the length such that an occupant could handle the device without having garments or skin pinched or injured by the rigid arms or fastening device.

Moreover, the basic design may be applied to windows and other entry ways into a home or building.

DESCRIPTION OF THE PREFERRED EMBODIMENTS

Figure 4:
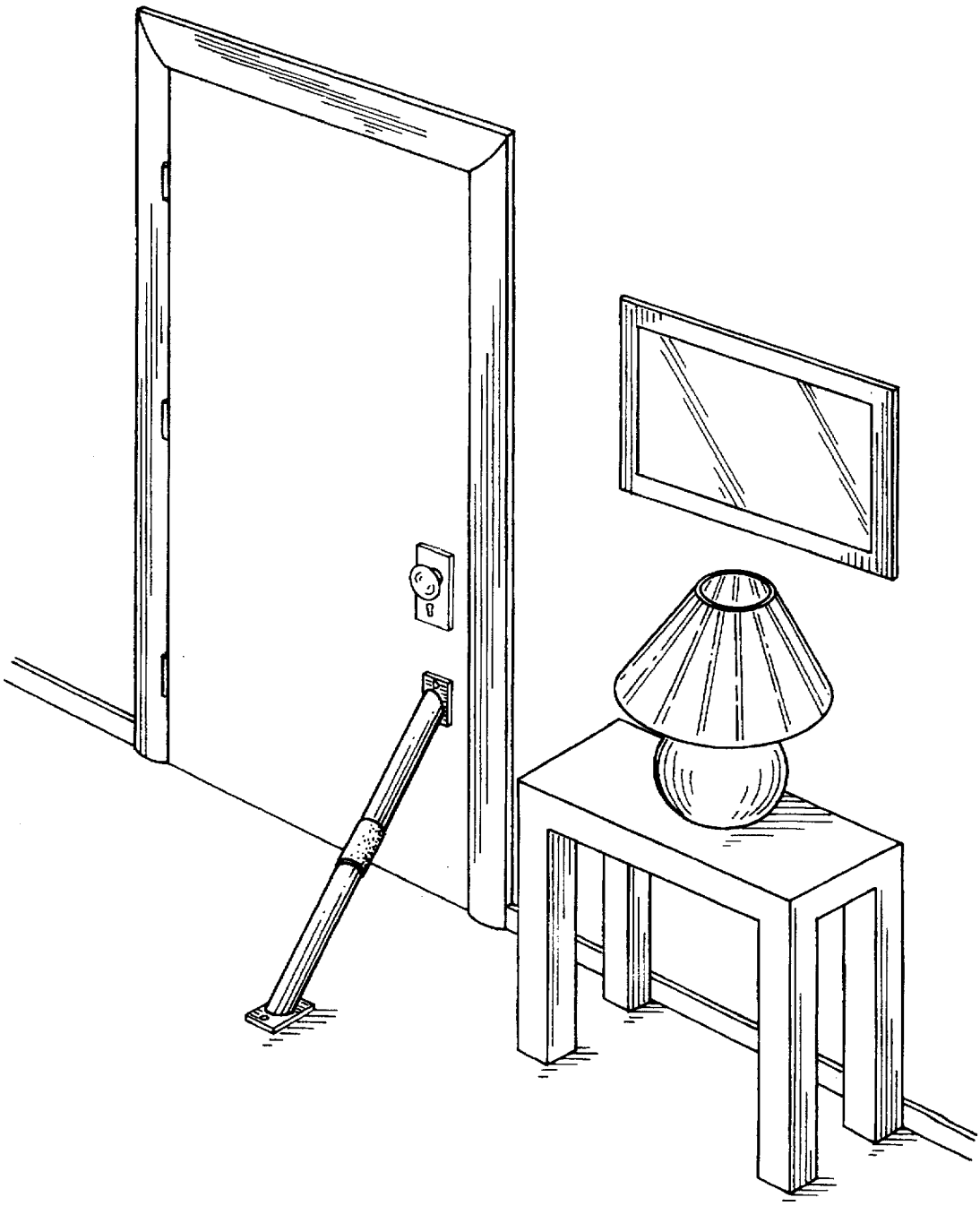
FIG. 4 shows a perspective view of the preferred embodiment as installed on a door.

The present invention has at least two rigid arms connected by a releasable fastening device holding the ends of the rigid arms together. Two arms are preferred. One end is secured to the floor a short distance behind a door, while the arms extend upward end to end to be secured to the door, thereby holding it closed against forced entry. FIG. 4 shows a perspective view of an embodiment of the door security device in use.

Figure 5:
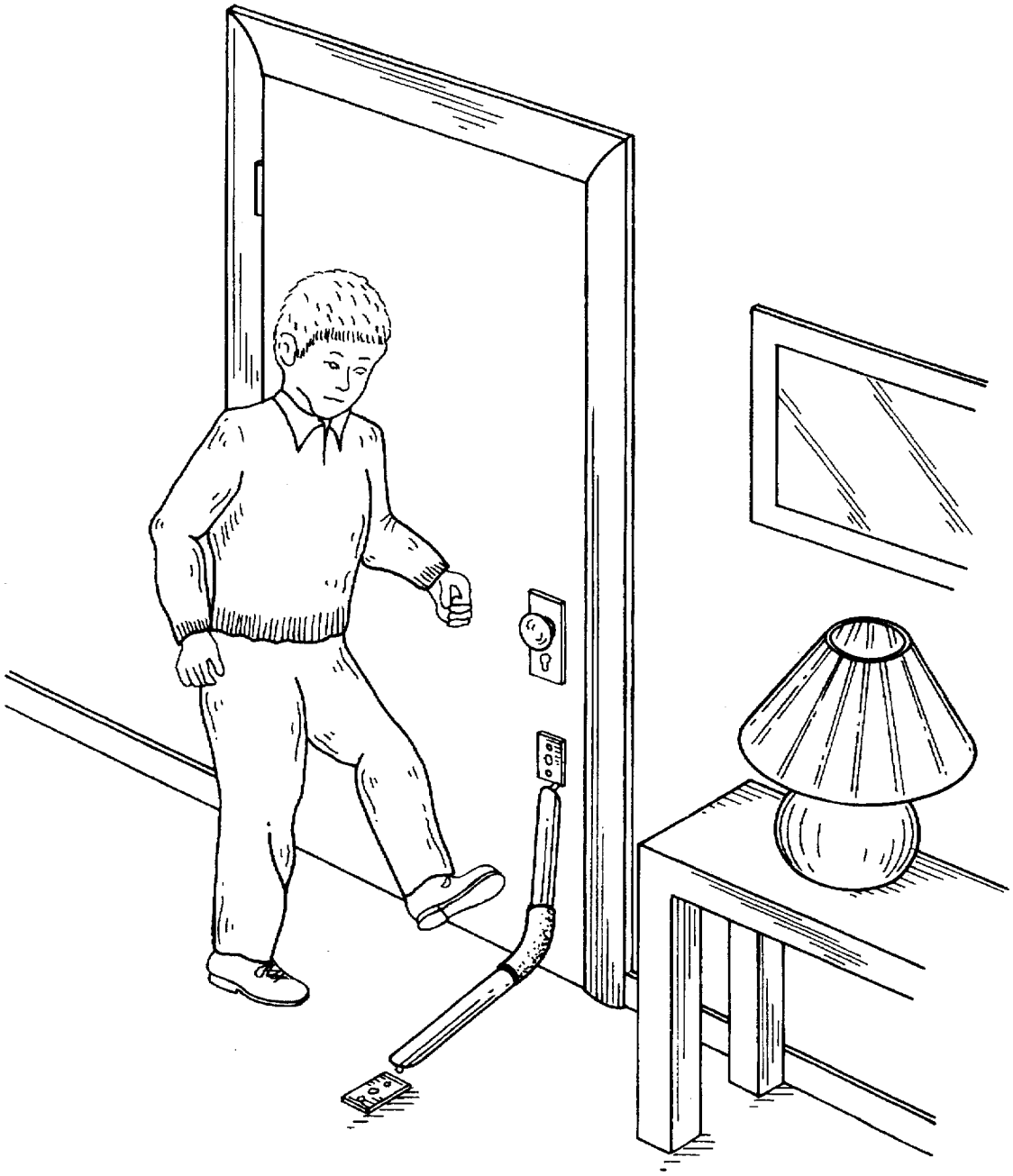
FIG. 5 shows a perspective view of the door security device being released by an occupant.

The fastening devices of the present invention releasably hold the proximal ends in position. The fasteners are designed to remain secure against force exerted at the distal ends of the rigid arms and together with the fixtures which are used to secure the distal ends to the floor and the door, prevent displacement of the proximal ends due to such force. The fastening devices allow easy manual release of the proximal ends from position in response to a force which may be exerted near the proximal ends, and substantially perpendicular to the axis of the rigid arms. Thus, as shown by FIG. 5, to remove the door securing device from its engaged position, an occupant need only push sideways on the device. There is no need for time consuming manipulation of handles, combination locks or the like and no tools or keys are required. Even an occupant limited in physical or mental ability by age, size or handicap could quickly release the door security device and exit the premises in case of an emergency.

Preferred embodiments of the invention will be described with reference to use on a door. Again, the device can also be adapted for use on window applications as well. It is appreciated that these preferred embodiments are used for descriptive purposes and are not intended to limit the scope of the subject matter to these particular embodiments.

Figure 1:
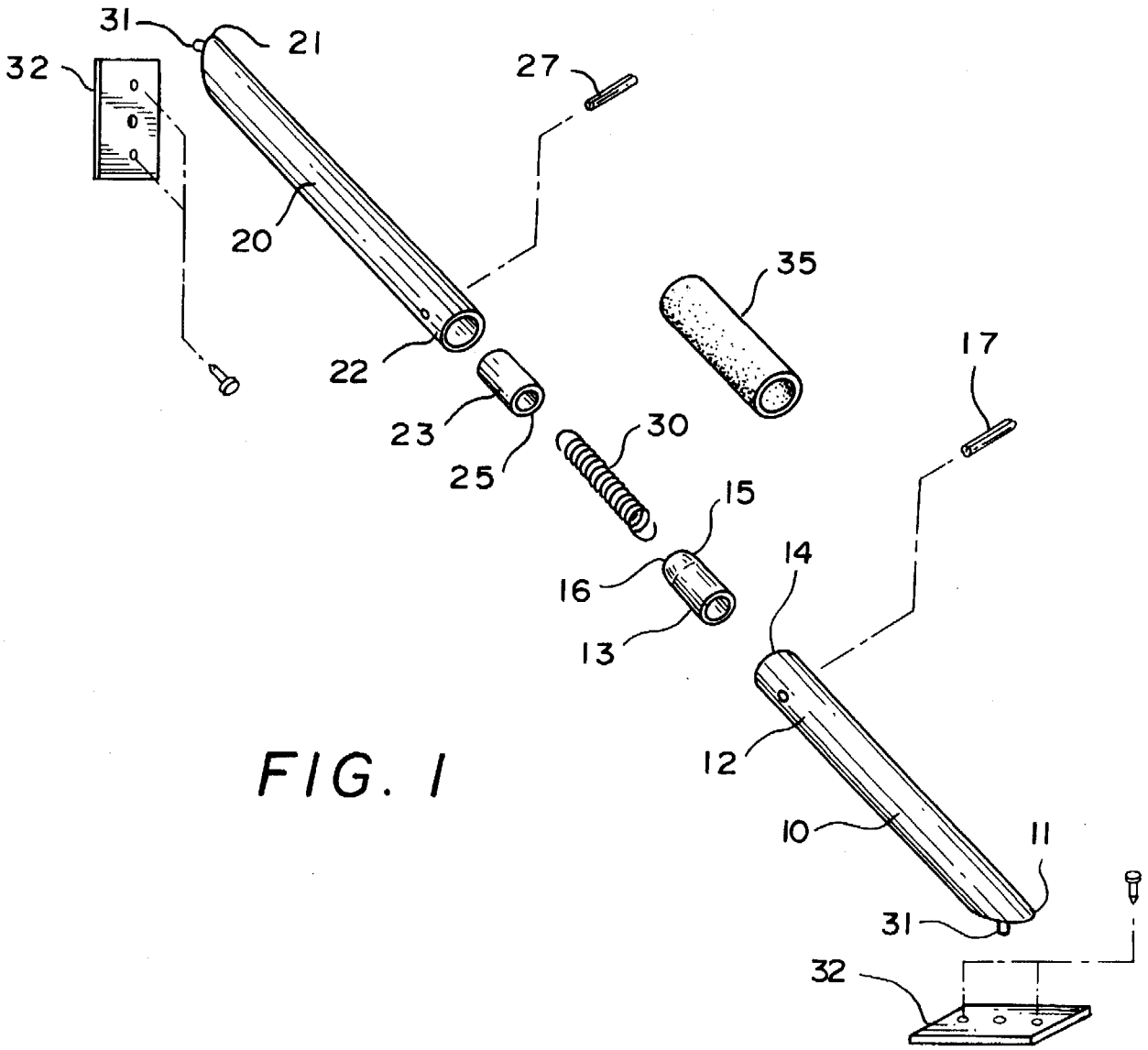
FIG. 1 shows an exploded view of one embodiment of the door security device.

With reference to FIG. 1, the door security device has a first rigid tube 10 and a second rigid tube 20. The first and second tubes, 10 and 20 respectively, are constructed of substantially rigid material with good resistance to compressive, bending, and shock type forces. In a particularly preferred embodiment, the tubes 10 and 20 are made of polymers such as plastics or composites. While in a most preferred embodiment, the tubes 10 and 20 are metal such as steel, aluminum or the like.

The tubes 10 and 20 are positioned with their proximal ends, 12 and 22 respectively, close together to form a substantially straight line. In a preferred embodiment, the proximal ends 12 and 22 are connected to each other and held releasably end to end by a spring 30. The spring 30 is connected to the proximal ends 12 and 22 through use of known fixing means. In the preferred embodiment, the spring 30 is held in place by transverse pins 17 and 27, at each end of the spring 30. These pins 17 and 27 extend across the lumen of the tubes, substantially transverse to the longitudinal axis of the tubes, and into the sides of the rigid tubes 10 and 20 respectively. The pins 17 and 27 are spaced a length apart which allows attachment of the ends of spring 30 to these pins with only small separation, if any, of the coils of the spring 30.

The spring 30 should have good resistance to deformation from compressive forces exerted along its longitudinal axis, while remaining manually deformable, to release the proximal ends from position, in response to force exerted near the proximal ends 12 and 22, and substantially perpendicular to the axis of the rigid tubes 10 and 20. In the preferred embodiment, the spring 30 is made of metal, such as steel or the like.

Although two arms are shown and discussed, it is further envisioned that it is possible to use more than two arms. I believe it is best to use two arms in which the length of the tubes 10 and 20 is approximately the same, ranging from 10 to 20 inches. While in a most preferred embodiment the length of tubes 10 and 20 is approximately 16 inches. The shape of the tubes 10 and 20, is not crucial to the invention and they can be any shape in cross-section, i.e. circular, square or even triangular. In a preferred embodiment, the tubes have a circular cross-section.

In the preferred embodiment shown in FIG. 1, the proximal ends 12 and 22 of the tubes 10 and 20 are lined with internal tubes 13 and 23 respectively, although tube 23 is not necessarily needed other than for additional support. The external circumference of the internal tubes 13 and 23 is slightly less than the internal circumference of proximal ends 12 and 22, allowing the internal tubes 13 and 23 to be inserted into and run parallel with rigid tubes 10 and 20 respectively. The internal tubes 13 and 23 are fixed to the inner surface 14 of the rigid tubes 10 and 20 by known means such as glue, welding or the like.

In the preferred embodiment, the inner tube 13 of proximal end 12 has an external terminal end 15 that extends a short length outside of the end of proximal end 12. This external terminal end 15 has a bevel 16 extending circumferentially around the outer surface of the external terminal end 15.

Also in this preferred embodiment, the internal tube 23 of proximal end 22 has an internal terminal end 25. The internal terminal end 25 is positioned within end 22 such that it stops short of the very end of proximal end 22 and thereby creates a length of rigid tube 20 which has a lumen large enough to allow entry of the external terminal end 15 of the internal tube 13.

Figure 2:
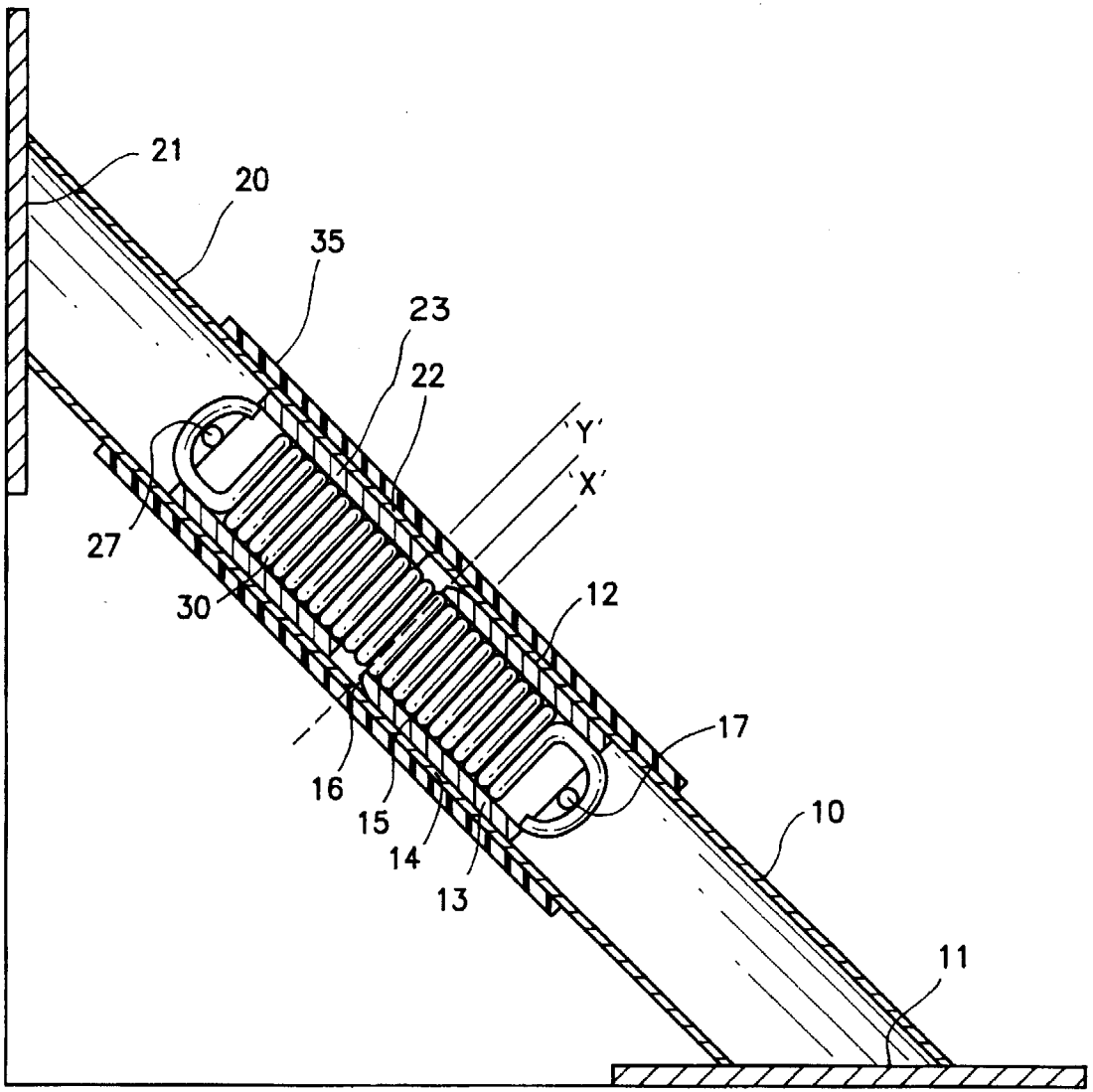
FIG. 2 shows a cutaway side view of one embodiment of the door security device installed on a door.

As shown more clearly in FIG. 2, in this embodiment, the proximal ends 12 and 22 thus form a butt end type connection, using the internal tubes 13 and 23. This connection which provides additional stability to the door securing device in resisting forces transmitted from the door as an intruder tries to open it. FIG. 2 also shows the relationship between the internal tubes 13 and 23 and the spring 30. Spring 30 is only slightly smaller than the lumen of the internal tubes 13 and 23. Spring 30 extends between and into the proximal ends 12 and 22 of the rigid tubes 10 and 20, through the inside of the internal tubes to the fixing point of the spring 30 at pins 17 and 27.

The bevel 16 provides for easier release of the engagement between the rigid tubes 10 and 20, through manual force on the tube sides at or near the proximal ends 12 and 22, by facilitating displacement of the proximal ends relative to each other.

Another aspect of the preferred embodiment of FIG. 1 is the flexible casing 35 that covers a portion of the tubes 10 and 20. The length of the rigid tubes 10 and 20 which is covered includes the spring 30 and the proximal ends 12 and 22. The flexible casing 35 extends circumferentially around the length such that an occupant could handle the device without having garments torn or skin pinched or injured by the rigid tubes 10 and 20 or by the spring 30. In a particularly preferred embodiment, the flexible casing is elastic surgical tubing.

Further aspects of the preferred embodiment include fixtures used to secure the door security device to the door and to the floor adjacent the door. With reference to FIG. 1, in the preferred embodiment, the distal ends 11 and 21 of the rigid tubes 10 and 20 are cut off at an angle to the longitudinal axis of the tubes 10 and 20 such that the edges of the distal ends 11 and 21 form a plane parallel to the surface of the door or floor adjacent the door with which the distal ends 11 and 21 will be in contact when the door security device is in use.

The first rigid tube 10 has a manipulable male engaging fixture 31 at the distal end 11 of the tube 10, to fasten the tube 10 to a door or floor adjacent the door. The second rigid tube 20 also has a manipulable male engaging fixture 31 at the distal end 21 of the tube 20, to fasten the tube 20 to a door or floor adjacent the door. The manipulable male engaging fixtures 31 correspond to female engaging fixtures 32 respectively, which are firmly attached to the door or floor adjacent the door by screws or similar known means.

In a particularly preferred embodiment, the engaging fixtures 31 are identical so that an occupant can quickly and easily attach the devices without having to first determine which end corresponds to the door and which to the floor which end corresponds to the door and which to the floor adjacent the door. In a particularly preferred embodiment, male engaging fixtures 31 each include a terminal surface 33 which closes the distal ends 11 and 21 of the tubes 10 and 20, and one stout shaft 34, firmly fixed to the tube by known means such as welding. The shaft 34 extends outward past the terminal surface 33 to engage a corresponding female fixture 32 which is fixed to a door or floor adjacent the door.

Also within the contemplation of the inventor and not departing from the claimed subject matter are other fixtures adapted to be removably secured to a door which would serve to attach the door security device, such as a Y-shaped distal end which engages the underside of a doorknob thereby securing the device to the door. Similarly, other fixtures adapted to be removably secured to a floor adjacent the door which would serve to attach the door security device are also contemplated, including a distal end fixture possessing a high coefficient of friction which frictionally engages the material of the floor adjacent the door thereby removably securing the device to the floor against forces which would displace the fixture by sliding. Besides those means listed above, other engagement means will be obvious to those of ordinary skill in the art.

Figure 6:
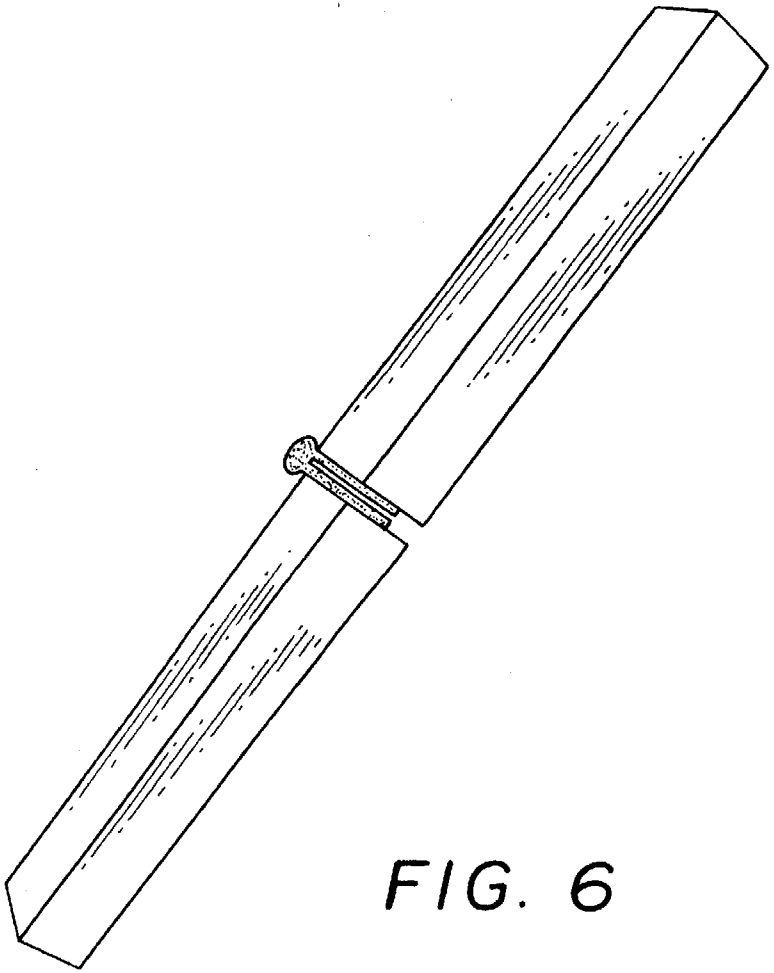
FIG. 6 shows a perspective view of a second embodiment of the present invention.
Figure 3:
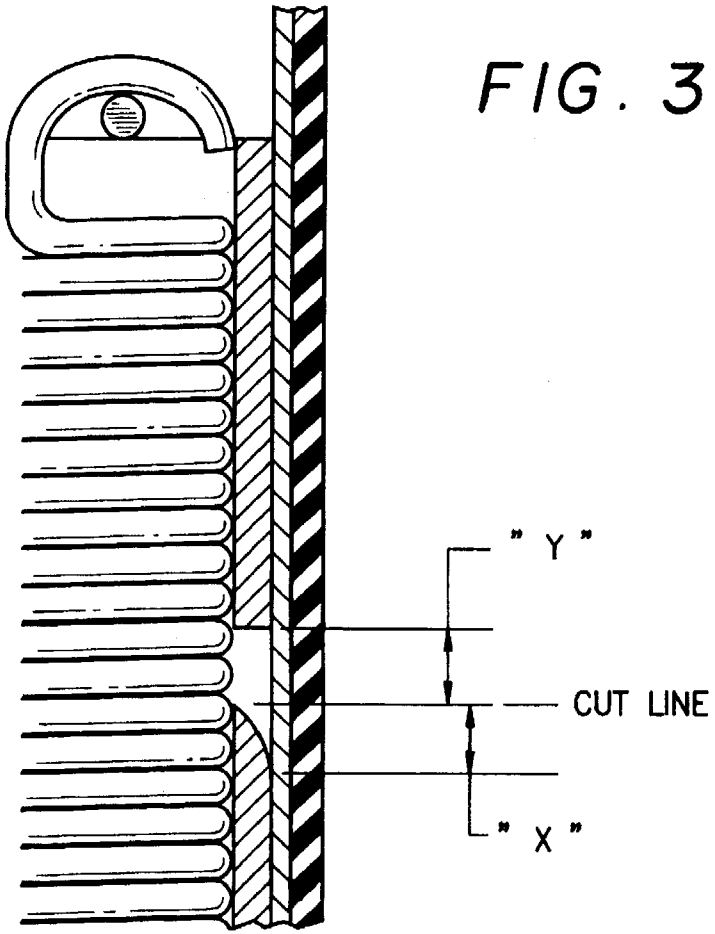
FIG. 3 shows a close-up view of the beveled release section of the most preferred embodiment of the present invention door security device.

Referring now to FIG. 6, there is shown a second preferred embodiment. This door security device includes two rigid arms which are solid in cross-section. These rigid arms each have a proximal and a distal end, and are positioned in a manner similar to the first embodiment. The proximal ends are held in position by a fastening device which allows pivotal movement of the proximal ends in response to force exerted near the proximal ends and substantially perpendicular to the axis of the rigid arms. However, this fastening device holds the proximal ends firmly in position when force is exerted on the distal ends. In a particularly preferred embodiment the fastening device is a hinge, a pivot, or a ball socket. Furthermore, it could include two hinges, one on each side.

The fixtures used to secure the door security device to the door and to the floor adjacent the door in the second preferred embodiment are substantially the same as those described in reference to the first preferred embodiment. In the embodiment with the hinge, pivot, or ball socket, the distal ends are further characterized as allowing a limited rotational movement of the distal ends in relation to the door and the floor adjacent the door in order to facilitate pivotal movement of the proximal ends.

It is within the scope of the inventor's subject matter that the proximal ends can be positioned somewhat apart or held in abutment or be moved into abutment during use by forces exerted along the longitudinal axis of the device, including the force of an intruder trying to force the door security device.

Particular embodiments have been described herein by way of example and are not intended to provide the metes and bounds of the subject matter of the invention, as modifications and improvements are contemplated which do not depart from the scope of the invention.

What is claimed is:

1. A home security device, comprising:

a first rigid tube having a proximal end with an internal circumference and an inner surface;

a second rigid tube, also having a proximal end with an internal circumference and an inner surface, said tubes being positioned proximal end to proximal end forming a substantially straight line, the end-to-end tubes having a longitudinal axis;

said first rigid tube also having a distal end adapted to be removably secured to a door or window;

said second tube also having a distal end adapted to be removably secured to a floor or wall adjacent the door or window; and a spring positioned between and connecting said proximal ends of the two rigid tubes, releasably holding the tubes in the substantially straight-line position such that when the device is secured to the door or window and the floor or wall, the device prevents opening the door or window from outside the door or window, the device being adapted to be released from the straight-line position in response to force exerted near the proximal ends and substantially perpendicular to the longitudinal axis of the end-to-end tubes, causing the device to bend between the proximal ends, thus releasing the device from preventing the opening of the door or window.

2. The home security device of claim 1, wherein:

one of the proximal ends is lined with an internal tube of circumference slightly less than the internal circumference of said proximal end; the internal tube being fixed to the inner surface of said proximal end, and having an external terminal end having an outer surface and extending past said proximal end of the rigid tube which surrounds the internal tube; and the external terminal end of the internal tube having a bevel extending circumferentially around the outer surface of the external terminal end.

3. A home security device, comprising:

a first rigid tube having a proximal end with an internal circumference and an inner surface;

a second rigid tube, also having a proximal end with an internal circumference and an inner surface, said tubes being positioned proximal end to proximal end;

said first rigid tube also having a distal end adapted to be removably secured to a door or window;

said second tube also having a distal end adapted to be removably secured to a floor or wall adjacent the door or window; and a spring positioned between and connecting said proximal ends of the two rigid tubes, releasably holding the tubes in position such that when the device is secured to the door or window and the floor or wall, the device prevents opening the door or window from outside but allows occupants to release the device by exerting force against a side of the tubes near the proximal ends, wherein one of the proximal ends is lined with an internal tube of circumference slightly less than the internal circumference of said one of the proximal ends; the internal tube being fixed to the inner surface of said one of the proximal ends, and having an external terminal end having an outer surface and extending past said one of the proximal ends of the rigid tube which surrounds the internal tube; and the external terminal end of the internal tube having a bevel extending circumferentially around the outer surface of the external terminal end, and a second one of the proximal ends is lined with an internal tube of circumference slightly less than the internal circumference of the second proximal end, the internal tube being fixed to the inner surface of the second proximal end, and having an internal terminal end which terminates before reaching the second proximal end of the rigid tube which surrounds the internal tube.

4. The home security device of claim 1, wherein the spring is partially internal to the proximal ends and holds said ends in abutment.

5. The home security device of claim 1, wherein at least one distal end has at least one manipulable female engaging fixture for engaging at least one male engaging fixture.

6. The home security device of claim 1, wherein at least one distal end has at least one manipulable male engaging fixture for engaging at least one female engaging fixture.

7. The home security device of claim 6, wherein the at least one manipulable male engaging fixture is in the form of a terminal surface closing the distal end of the tube, and at least one shaft, firmly fixed to the tube, extending outward past the terminal surface for engaging a corresponding female fixture.

8. The home security device of claim 1, wherein the distal end adapted to be removably secured to a door has a Y-shaped fitting to be positioned under a doorknob.

9. The home security device of claim 1, wherein at least one distal end adapted to be removably secured by frictional engagement between the distal end and a surface.

10. The home security device of claim 1, further comprising a flexible casing covering a length of the rigid tubes which includes the spring and the proximal ends of the two rigid tubes, extending circumferentially around the length such that the device can be handled without having garments or skin injured by the rigid tubes or spring.

11. A home security device comprising:

a first attachment device, mounted on a distal end of a first rigid arm, adapted to be removably secured to a door or window;

a second attachment device, mounted on a distal end of a second rigid arm, adapted to be removably secured to a floor or wall adjacent the door or window;

proximal ends of the first and second rigid arms being positioned end to end to form a substantially straight line, the end-to-end rigid arms having a longitudinal axis; and a fastening device, releasably holding the proximal ends in the substantially straight-line position, adapted to remain secure against force exerted at the distal ends of the rigid arms preventing the opening of the door or window when the device is secured to the door or window and the floor or wall and to release the proximal ends from the straight-line position in response to force exerted near the proximal ends and substantially perpendicular to the longitudinal axis of the end-to-end rigid arms, causing the fastening device to bend between the proximal ends, thus releasing the security device from preventing the opening of the door or window.

12. The home security device of claim 11, wherein the two rigid arms are solid in cross-section.

13. The home security device of claim 11, wherein the fastening device is selected from the group consisting of at least one hinge, pivot, and ball socket.

14. The home security device of claim 11, wherein at least one distal end has a manipulable male engaging fixture for engaging a female engaging fixture attached to the door, window, floor or wall adjacent the door or window.

15. The home security device of claim 11, wherein the two rigid arms have the same shape and size and are hollow in cross-section.

16. The home security device of claim 11, wherein one of the proximal ends has a rigid internal lining having an external terminal end extending past said proximal end of the rigid arm which surrounds the internal lining, said terminal end having a bevel extending circumferentially around the outer perimeter of the external terminal end.

17. The home security device of claim 14, wherein a second one of the proximal ends has a rigid internal lining which terminates before reaching the second proximal end of the rigid arm which surrounds the internal lining.

18. The home security device of claim 11, further comprising a flexible casing covering a length of the rigid arms which includes the fastening device and the proximal ends of the two rigid arms, extending circumferentially around the length such that the device can be handled without having garments or skin injured by the rigid arms or fastening device.

19. A home security device comprising:

first and second arms of equal diameter;

said first arm having one beveled end and one securable end;

said second arm having one abutting end and one securable end;

the securable ends being adapted to be releasably secured one to a door or window, and one to a floor or wall adjacent the door or window; and a fastening device connected to the abutting end and the bevelled end, holding said beveled end to said abutting end and releasably locking the two arms together in a substantially straight line, the locked arms having a longitudinal axis, the fastening device locking the two arms together such that force transmitted substantially along the longitudinal axis of the locked arms will not cause the abutting and beveled ends to disengage, while force exerted near the fastening device and substantially perpendicular to said axis will cause disengagement by bending the fastening device between the abutting end and the bevelled end.

20. The home security device of claim 1, wherein the spring is inside each of the two proximal ends and extends between the two proximal ends.

* * * * *